US005591557A

United States Patent [19]

Lawson et al.

[11] Patent Number: 5,591,557

[45] Date of Patent: Jan. 7, 1997

[54] LIQUID DEVELOPER INCLUDING ORGANO TITANATE CHARGE CONTROL AGENT FOR ELECTROSTATOGRAPHY

[75] Inventors: Terence M. Lawson, Aldgate; Stephen L. Nicholls, Willunga, both of Australia

[73] Assignee: Research Laboratories of Australia Pty Ltd., Eastwood, Australia

[21] Appl. No.: 500,884

[22] PCT Filed: Jan. 18, 1994

[86] PCT No.: PCT/AU94/00021

§ 371 Date: Jul. 21, 1995

§ 102(e) Date: Jul. 21, 1995

[87] PCT Pub. No.: WO94/17453

PCT Pub. Date: Aug. 4, 1994

[30] Foreign Application Priority Data

Jan. 22, 1993 [AU] Australia ..... PL6905

[51] Int. Cl.[6] ..... G03G 9/135

[52] U.S. Cl. ..... 430/115; 430/116

[58] Field of Search ..... 430/116, 115

[56] References Cited

U.S. PATENT DOCUMENTS 3,053,688 9/1962 Greig .
3,105,821 10/1963 Johnson .
5,155,534 10/1992 Kurotori et al. .

FOREIGN PATENT DOCUMENTS 0247248 12/1987 European Pat. Off. .

OTHER PUBLICATIONS

Chemical Abstracts 112:189009 1990.
Chemical Abstracts 113:106325 1990.
Chemical Abstracts 121:267823 1994.
Diamond, Arthur S. Handbook of Imaging Materials. New York: Marcel–Dekker, Inc. pp. 231–232 1991.
Derwent Abstract Accession No. 92–421923/51, Class S06, JP,A, 4–319961 (Seiko Epson Corp), Nov. 10, 1992—Abstract.

*Primary Examiner*—Christopher D. Rodee
*Attorney, Agent, or Firm*—Evenson, McKeown, Edwards & Lenahan

[57] ABSTRACT

A liquid developer for electrostatography comprising a silicone fluid, marker particles and a charge control agent which is soluble in the silicone fluid. The charge control agent may be an organo-metallic compound such as an organo titanate selected from tetra-2-ethyl hexyl titanate, tetra-n-butyl titanate and tetra isopropyl titanate. The organo-metallic compound may be present in a range of from 0.01 to 10% by weight of the toner particles, with a preferred range of 0.1 to 2% by weight. A colourant may also be included.

6 Claims, No Drawings

LIQUID DEVELOPER INCLUDING ORGANO TITANATE CHARGE CONTROL AGENT FOR ELECTROSTATOGRAPHY

TECHNICAL FIELD

This invention relates to liquid developers suitable for electrostatography.

BACKGROUND ART

Electrostatography is a term used to describe various non-impact printing processes which involve the creation of a visible image by the attraction of charged imaging particles to charge sites present on a substrate. Such charge sites, forming what is usually termed the "latent image", can be transiently supported on photoconductors or pure dielectrics, and may be rendered visible in situ or be transferred to another substrate to be developed in that location. Additionally, such charge sites may be the reflection of those structured charges existing within a permanently polarised material, as is the case with ferroelectrics and other such electrets.

Electrostatography encompasses those processes normally known as electrophotography and electrography.

In general, a liquid developer for electrostatography is prepared by dispersing an inorganic or organic colorant such as iron oxide, carbon black, nigrosine, phthalocyanine blue, benzidine yellow, quinacridone pink and the like into a liquid vehicle which may contain dissolved or dispersed therein synthetic or naturally occurring polymers such as acrylics, alkyds, rosins, rosin esters, epoxies, polyvinyl acetate, styrene-butadiene etc. Additionally, to effect or enhance the electrostatic charge on such dispersed particles, additives known as charge directors or charge control agents may be included. Such materials can be metallic soaps, fatty acids, lecithin, organic phosphorus compounds, succinimides, sulphosuccinates etc.

In such developers, whether positively or negatively charged, there is one ingredient of common generic character, namely the carrier liquid. Since the beginning of the history of liquid toners, it has been recognised that certain electrical properties of the carrier liquid are mandatory requirements for the effective functioning of a conventional electrostatographic liquid development process. These are low electrical conductivity and other requirements became obvious, such as the needs for low toxicity, increased fire safety, low solvent power, low odour etc. For these reasons, isoparaffinic-hydrocarbons such as the Isopar range manufactured by Exxon Corporation, the Shellsol range manufactured by Shell Chemical and the Soltrol range manufactured by Phillips Petroleum became the industry standards for liquid toner carriers.

In more recent times, however, certain deficiencies in these isoparaffins have become apparent. Environmental concerns have placed liquid development processes under increasing pressure to reduce or eliminate volatile emissions. Flammability has also become important regarding the more stringent transport regulations existing and anticipated worldwide.

New designs of image fusing stations are placing increased importance on the thermal stability of carrier liquids.

In order to overcome these limitationsother materials applicable to liquid toners have been investigated and of these, silicone fluids are clearly liquids which combine all previously and currently desired properties of a modern liquid toner carrier.

Silicone fluids have been mentioned in the context of liquid toners, e.g. in U.S. Pat. Nos. 3,105,821 to S. W. Johnson, and in 3,053,688 to H. G. Greig. Both of these early patents recognised the virtues of silicone fluids, but the understanding of the functioning of liquid toners at that time was relatively empirical, with those patents teaching simply the mechanical dispersion of a dry toner into the silicone fluid with no regard to chemical compatibility, which in turn governs the final particle size and stability of the dispersion so produced. More recently silicone fluids have again been recognised, as disclosed in JPA-H3–43749.

However, in this application reliance is also placed on mechanical dispersion only and in addition no mention is made of chemical compatibility or most importantly, charge directors, the need for which being well established in the field of liquid electrostatic toners.

It is well known that silicone fluids have low solvent power for plastics and this property is well suited for copy machine components and organic photoconductor life. An unfortunate corollary to this is that many polymers normally used in liquid toners, whether they are chemically prepared such as in U.S. Pat. Nos. 3,990,980 to G. Kosel or more recently 5,112,716 to Kato et al or by conventional dispersion techniques such as in JPA-H3–43749, are either insoluble in or incompatible with silicone fluids. This severely limits the particle size attainable and the stability of dispersions thus prepared due to the inability of such polymers to dissolve in the silicone fluid and subsequently to be adsorbed onto dispersed colorants, providing a steric barrier to their reagglomeration.

Thus the need exists for a stable liquid developer which meets modern environmental demands and yet has the imaging capability required by quality printing standards, namely colour gamut and resolution.

Thus an object of the invention is to provide an electrostatographic toner containing an unadulterated silicone fluid as the carrier liquid.

Another object of the present invention is to provide an electrostatographic toner composition having stable particle charge properties achieved by a silicone fluid compatible charge director.

This invention relates to a liquid developer for electrostatography, comprising particles which may contain or comprise pigments or dyes as colourants and a charge control agent, dispersed in a liquid carrier having an electrical resistance of at least $10^9$-ohm-cm and having a dielectric constant of not more than 3.5. In particular this carrier liquid is further characterised by being silicon containing organic compounds, generally known as silicone fluids.

DISCLOSURE Of THE INVENTION

In one form, therefore the invention is said to reside in a liquid developer for electrostatography comprising a silicone fluid, marker particles and a charge control agent comprising an organo titanate compound.

The organo titanate may be selected from tetra-2-ethyl hexyl titanate, tetra n-butyl titanate and tetra isopropyl titanate.

The organo-metallic compound may be present in a range of from 0.01 to 10% by weight of the toner particles, with a preferred range of 0.1 to 2% by weight.

The marker particles may be any particle suitable for a form of electrostatography. They may be or include polymers, binders, pigments, dyes and other known components.

The polymer particles may have a colourant selected from a pigment and a dye adsorbed thereon.

The silicone fluid is selected from polyphenylmethylsiloxanes, dimethyl polysiloxanes and polydimethyl cyclosiloxanes Hence it will be seen that the present invention provides a liquid electrostatographic toner composition in which the carrier liquid is purely silicone fluid by chemical nature and is unadulterated by any hydrocarbon based liquid. Particle size, dispersion stability and particle charge may be achieved by a combination of mechanical dispersion and compatible charge director.

BEST MODE FOR CARRYING OUT THE INVENTION

The present invention thus provides an improved electrostatographic liquid developer composition containing colorant and toner particles such as a polymer dispersed in an electrically insulating silicone fluid and a silicone fluid compatible charge directors such as an organo-titanates.

The invention will now be discussed with reference to a preferred embodiment.

Non-aqueous dispersions of many types of polymers are well known in the art of toner making. However, the non-aqueous phase in these has been limited to hydrocarbon liquids and more specifically to isoparaffinic hydrocarbons. Silicone fluids have not featured in this technology.

Silicone fluids are comprised of a range of compounds, the most commonly encountered types being dimethyl polysiloxanes which have the following chemical structure:

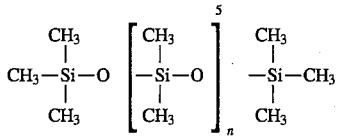

where n may vary from 0 to 2000 and even higher. The higher the value of n the higher the viscosity of the silicone fluid. Viscosity of these particular polysiloxanes can range from 0.65 centistokes to over 1,000,000 centistokes. In a preferred range for the present invention the viscosity may be in the range of from 0.65 to 60,000 centistokes.

The silicone fluids may be selected from silicone fluids of low viscosity such as certain polyphenylmethylsiloxanes and polydimethyl cyclosiloxanes or silicone fluids of higher viscosities such as dimethyl polysiloxanes.

The colouring the liquid developer as a necessary part of the toner making procedure, a method of physically incorporating a pigment or dye into the dispersion can be employed. Other methods well known in the art such as the adsorption of dye to the dispersed polymer facilitated by the application of heat to a mixture of dyestuff and the polymer dispersion can also be employed.

It is well known to those skilled in the art of toner making that liquid toners are more stable and more predictable when materials known as charge directors, charge control agents or charge enhancers are incorporated into the toner composition. Many patents have been granted regarding the composition and efficacy of these materials e.g. in U.S. Pat. Nos. 3,411,936 to J. Roteman et al, in 3,417,019 to G. L. Beyer, in 4,170,563 to S. H. Merrill et al, in 4,897,332 to G. Gibson et al and in 5,045,425 to R. Swindler. In addition many theoretical papers have been written in attempts to explain the functioning of these additives, e.g. Mechanism of Electric Charging of Particles in Non-aqueous Liquids (Colloids and Surfaces in Reprographic Technology 1982) by F. M. Fowkes et al.

During the course of experimentation with liquid toners based on silicone fluids as the sole liquid carrier we found that the normally employed charge directors are either insoluble or incompatible with silicone fluids.

We have found that materials such as certain metallic soaps supplied as solutions, e.g. zirconlure octoate, manganese naphthenate and the like, once their solvents have been removed in order not to contaminate the purity of the silicone carrier have problems with stability of solution and can precipitate out over time.

We have found that certain members of a specific class of organo-metallic compounds, the organo-titanates, can, in the complete absence of any other liquid or solvent, be completely dissolved in silicone fluids and in doing so, effect, enhance and stabilise an electrostatic charge on toner and colorant particles dispersed in that silicone fluid by the procedures taught herein.

Specific examples of such organo-titanates are tetra-2-ethyl hexyl titanate, tetra octyl titanate, tetra n-butyl titanate and tetra isopropyl titanate. The organo-titanate can be used in the liquid toner of the present invention in quantities of 0.01 to 10% by weight of the dispersed polymer, with a preferred range of 0.1 to 2% by weight.

COMPARATIVE EXAMPLE

This example shows the use of silicone fluids as carriers for liquid developers but without inclusion of a charge control agent.

| | |
|---|---|
| Kunstharz SK | 100 g |
| DC 344 Fluid | 400 g |
| Phthalocyanine blue | 20 g |

Kunstharz SK is a ketone aldehyde polymer resin DC 344 Fluid is a silicone fluid with a viscosity of 2 centistokes The above ingredients were added to a ball jar and milled for 4 days. The blue pigment/resin dispersion so formed was then used to develop a latent image on a charged recording member. Overall image quality was poor and the image exhibited background fog. Maximum image density was 0.4 optical density units (odu) as measured by a Gretag SP100 reflection densitometer.

The liquid developer compositions as set forth in the following examples exemplify and are within the scope of the present invention.

EXAMPLES OF THE INVENTION

EXAMPLE 1

| | |
|---|---|
| Kunstharz SK | 100 g |
| DC 344 Fluid | 400 g |
| Phthalocyanine blue | 20 g |
| Zirconium octoate | 0.5 g |

The Zirconium octoate was used as a 25% solution in white spirit and contained 6% by weight of zirconium. Upon removal of the white spirit the zirconium octoate remained in solution but the solution was unstable and the zirconium octoate precipitated out in time.

The above ingredients were added to a ball jar and milled for 4 days. The blue pigment/resin dispersion so formed was then used to develop a latent image on a charged recording member. Overall image quality was fair. Maximum image density was 0.4 optical density units (odu) as measured by a Gretag SP100 reflection densitometer.

EXAMPLE 2

| | |
|---|---|
| Kunstharz SK | 100 g |
| DC 344 Fluid | 400 g |
| Phthalocyanine blue | 20 g |
| Tetra Octyl Titanate | 0.5 g |

The above ingredients were added to a ball jar and milled for 4 days. The blue pigment/resin dispersion so formed was then used to develop a latent image on a charged recording member. Image quality was very good with excellent resolution. Maximum image density was 0.6 optical density units (odu) as measured by a Gretag SP100 reflection densitometer.

It will be noted that without the use of charge control agent as can be seen in the comparative example poor image quality is obtained. The addition of Zirconium Octoate gave some improvements but as this is not completely soluble in the silicone fluid good quality is not obtained. Best quality is obtained using Tetra Octyl Titanate which is soluble in the silicone fluid.

We claim:

1. A liquid developer for electrostatography comprising a silicone fluid, marker particles and a compatible charge control agent comprising an organo titanate compound selected from the group consisting of tetra 2-ethylhexyl titanate, tetra octyl titanate, tetra n-butyl titanate and tetra isopropyl titanate.

2. A liquid developer for electrostatography as in claim 1 wherein the organo titanate compound is present in a range of from 0.01 to 10% by weight of the marker particles.

3. A liquid developer for electrostatography as in claim 2, wherein the organo titanate compound is present in a range of from 0.1 to 2% by weight of the marker particles.

4. A liquid developer for electrostatography as in claim 1 wherein the marker particles are polymer particles.

5. A liquid developer for electrostatography as in claim 4 wherein the polymer particles have adsorbed thereon a colorant selected from the group consisting of a pigment and a dye.

6. A liquid developer for electrostatography as in claim 1 wherein the silicone fluid is selected from the group consisting of polyphenylmethylsiloxanes, dimethyl polysiloxanes and polydimethyl cyclosiloxanes.

* * * * *